US011108143B2

(12) United States Patent
Leung et al.

(10) Patent No.: US 11,108,143 B2
(45) Date of Patent: Aug. 31, 2021

(54) ANTENNA AND RELATED COMMUNICATION DEVICE

(71) Applicant: City University of Hong Kong, Kowloon (HK)

(72) Inventors: Kwok Wa Leung, Kowloon Tong (HK); Li Ying Feng, Tianjin (CN)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/560,031

(22) Filed: Sep. 4, 2019

(65) Prior Publication Data

US 2021/0066789 A1 Mar. 4, 2021

(51) Int. Cl.

| | |
|---|---|
| ***H01Q 1/38*** | (2006.01) |
| ***H01Q 1/48*** | (2006.01) |
| ***H01Q 1/50*** | (2006.01) |
| ***H01Q 9/04*** | (2006.01) |
| ***H01Q 5/10*** | (2015.01) |
| ***H01Q 5/307*** | (2015.01) |
| ***H01Q 13/08*** | (2006.01) |

(52) U.S. Cl.

CPC ..... *H01Q 1/38* (2013.01); *H01Q 1/48* (2013.01); *H01Q 1/50* (2013.01); *H01Q 5/10* (2015.01); *H01Q 5/307* (2015.01); *H01Q 9/0485* (2013.01); *H01Q 13/08* (2013.01)

(58) Field of Classification Search

CPC ..... H01Q 1/36; H01Q 5/10; H01Q 9/0485

See application file for complete search history.

(56) References Cited

U.S. PATENT DOCUMENTS

| | | | | |
|---|---|---|---|---|
| 4,546,333 | A * | 10/1985 | Fukasawa | H01P 1/2056 333/202 |
| 4,626,865 | A * | 12/1986 | Rammos | H01Q 1/38 343/786 |
| 6,445,345 | B1 * | 9/2002 | Kamimoto | H01P 3/081 333/26 |
| 10,727,565 | B2 * | 7/2020 | Kim | H01Q 1/2283 |
| 2008/0272963 | A1 * | 11/2008 | Chang | H01Q 1/2291 343/700 MS |
| 2019/0288399 | A1 * | 9/2019 | Tanaka | H01Q 1/48 |

OTHER PUBLICATIONS

L. Y. Feng et al, "Dual-frequency folded-parallel-plate antenna with large frequency ratio," IEEE Trans. Antennas Propag., vol. 64, No. 1, pp. 304-245, Jan. 2016.

H. M. Chen et al, "A compact dual-band dielectric resonator antenna using a parasitic slot," IEEE Antennas Wireless Propag. Lett., vol. 8, pp. 173-176, Aug. 2009.

K. S. Fang et al, "Singly-fed dual-band circularly polarized dielectric resonator antenna," IEEE Antennas Wireless Propag. Lett., vol. 13, No. 6, pp. 995-998, 2014.

(Continued)

*Primary Examiner* — Wei (Victor) Y Chan

(74) *Attorney, Agent, or Firm* — Renner Kenner Greive Bobak Taylor & Weber

(57) ABSTRACT

An antenna including a dielectric block with a groove, and a conductor arranged in the groove. The antenna is arranged to be excited to operate as a dielectric resonator antenna and a Fabry-Perot resonator antenna.

25 Claims, 18 Drawing Sheets

(56) References Cited

OTHER PUBLICATIONS

K. S. Fang et al, "Linear-/circular-polarization designs of dual-/wide-band cylindrical dielectric resonator antennas," IEEE Trans. Antennas Propag., vol. 60, No. 6, pp. 2662-2671, Jun. 2012.
K. Lu et al, "A new Fabry-Perot resonator antenna fed by an L-probe," IEEE Trans. Antennas Propag., vol. 60, No. 3, pp. 1237-1244, Mar. 2012.
K. Konstantinidis et al, "Multilayer partially reflective surfaces for broadband Fabry-Perot cavity antennas," IEEE Trans. Antennas Propag., vol. 62, No. 7, pp. 3474-3481, Jul. 2014.
Y. F. Lu et al, "A hybrid approach for finite-size Fabry-Perot antenna design with fast and accurate estimation on directivity and aperture efficiency," IEEE Trans. Antennas Propag., vol. 61, No. 11, pp. 5395-5401, Nov. 2013.
R. Gardelli et al, "Array thinning by using antennas in a Fabry-Perot cavity for gain enhancement," IEEE Trans. Antennas Propag., vol. 54, No. 7, pp. 1979-1990, Jul. 2006.
N. Guerin et al, "A metallic Fabry-Perot directive antenna," IEEE Trans. Antennas Propag., vol. 54, No. 1, pp. 220-224, Jan. 2006.
W. Pan et al, "A low-RCS and high gain partially reflecting surface antenna," IEEE Trans. Antennas Propag., vol. 62, No. 2, pp. 945-949, Feb. 2014.
D. R. Jackson et al, "Gain enhancement methods for printed circuit antennas," IEEE Trans. Antennas Propag., vol. 33, No. 9, pp. 976-987, Sep. 1985.
D. R. Jackson et al, "A leaky-wave analysis of the high-gain printed antenna configuration," IEEE Trans. Antennas Propag., vol. 36, No. 7, pp. 905-910, Sep. 1988.
M. A. Al-Tarifi et al, "The Puck Antenna: A Compact Design with Wideband, High-Gain Operation," IEEE Trans. Antennas Propag., vol. 63, No. 4, pp. 1868-1873, Apr. 2015.
K. L. Wong et al, "Analysis of a hemisphere dielectric resonator antenna with an airgap," IEEE Microw. Guided Wave Lett., vol. 3, No. 10, pp. 355-357, Oct. 1993.
E. H. Lim et al, "Novel application of the hollow dielectric resonator antenna as a packaging cover," IEEE Trans. Antennas Propag., vol. 54, No. 2, pp. 484-487, Feb. 2006.
E. H. Lim et al, "The compact circularly-polarized hollow rectangular dielectric resonator antenna with an underlaid quadrature coupler," IEEE Trans. Antennas Propag., vol. 59, No. 1, pp. 288-293, Jan. 2011.
X. S. Fang et al, "Compact differential rectangular dielectric resonator antenna," IEEE Antennas Wireless Propag. Lett, vol. 9, pp. 662-665, 2010.
K. W. Leung et al, "Dual-function radiating glass for antennas and light covers—Part I: Omnidirectional glass dielectric resonator antennas." IEEE Trans. Antennas Propag., vol. 61, No. 2, pp. 578-586, Feb. 2013.
K. W. Leung et al, "Dual-function radiating glass for antennas and light covers—Part II: Dual-band glass dielectric resonator antennas." IEEE Trans. Antennas Propag., vol. 61, No. 2, pp. 587-597, Feb. 2013.

* cited by examiner

E-plane (x-z plane)

H-plane (y-z plane)

ANTENNA AND RELATED COMMUNICATION DEVICE

TECHNICAL FIELD

The invention relates to an antenna and a communication device having one or more such antennas.

BACKGROUND

Recently, the demand for multi- (e.g., dual-) frequency antenna systems in radar and wireless communication systems has increased. One example is the desire to have radio-on-fiber links to simultaneously carry microwave radio signals and high-speed millimeter-wave signals. Another impetus comes from the endeavor to design wide-band communication systems that comply with 4G, 5G, and future wireless standards that include millimeter-wave bands. Coverage of two or more widely-separated wave bands may thus be desirable.

Thus, there is a need for an antenna, in particular a multi- (e.g., dual-) frequency antenna with a high-frequency ratio, to cover two or more widely-separated frequency/wave bands.

Some existing systems/methods provide such antennas by using two or more radiators, either vertically stacked or horizontally arranged, each operating at a different frequency band. These systems/methods may provide a high frequency ratio, but they are relatively heavy and bulky.

U.S. Pat. No. 9,966,662B proposes a solution that improves on these existing systems/methods. It teaches a compact dual-frequency antenna based on a single radiator with two back-to-back folded plates. In this structure, the folded plates form a microwave parallel-plate waveguide resonator antenna and the separation between the folded plates gives a millimeter-wave Fabry-Perot resonator antenna. The waveguide resonator antenna and Fabry-Perot resonator antenna provide bandwidths of 9.7% and 2.1% and cover the 2.4 and 24 GHz ISM bands, respectively. Problematically, however, much wider bandwidths would be required to simultaneously support two or more of 4G, 5G, and future standard communications. Also, the antenna disclosed is rather heavy as it uses relatively thick metals to keep the conductive plates parallel.

SUMMARY OF THE INVENTION

It is an object of the invention to address the above needs, to overcome or substantially ameliorate the above disadvantages or, more generally, to provide an antenna, in particular a multi- (e.g., dual-) frequency antenna that is compact, light, and operationally-effective in supporting 4G, 5G, or any other future wireless communication standards.

In accordance with a first aspect of the invention, there is provided an antenna, comprising a (single) dielectric block with a groove, and a conductor arranged in the groove; the antenna is arranged to be excited to operate as a dielectric resonator antenna and a Fabry-Perot resonator antenna. The antenna can also be selectively excited to operate as a dielectric resonator antenna alone or as a Fabry-Perot resonator antenna alone, and can be simultaneously excited to operate as both a dielectric resonator antenna and a Fabry-Perot resonator antenna Preferably, the dielectric block is substantially solid, and may have a generally rectangular form.

Preferably, the groove extends through the dielectric block from a first end of the dielectric block to a second end of the dielectric block, and the first and second ends are opposite ends.

Preferably, the dielectric block includes opposite side-surfaces and a base surface that together define the groove, and the conductor comprises one or more conductor strips arranged at least partly on the opposite side-surfaces and the base surface. The ground plane of the Fabry-Perot resonator antenna may be provided by the conductor strip on the base surface.

Preferably, the opposite side surfaces are generally parallel.

Preferably, the opposite side surfaces are separated by a first distance, and the first distance is at least a half-wavelength distance.

Optionally, the groove includes a first portion at the middle and second and third portions at two ends. At the first portion, the opposite side surfaces are separated by a first distance; at the second portion, the opposite side surfaces are separated by a second distance; at the third portion, the opposite side surfaces are separated by a third distance. The first distance is larger than the second distance and the third distance. Preferably, the first distance is at least a half-wavelength distance. Preferably, the second distance equals the third distance.

Preferably, the antenna further includes a first excitation member for receiving an excitation signal to operate the antenna as the dielectric resonator antenna. The first excitation member may include a conductor strip arranged on an outer surface of the dielectric block. The conductor strip may be generally rectangular or generally trapezoidal, tapered, etc.

Preferably, the antenna further includes a second excitation member for receiving an excitation signal to operate the antenna as the Fabry-Perot resonator antenna. Preferably, the groove generally elongates in a first direction, and the dielectric block further includes an opening continuous with the groove and generally extends in a second direction perpendicular to the first direction. Preferably, the opening is continuous with the groove in a central portion of the groove. Preferably, the second excitation member comprises a L-probe arranged at least partly in the opening. The antenna may further include an air-filled metallic cable arranged in the opening and generally coaxially with a portion of the L-probe in the opening. The antenna may further include a suppressor for suppressing cross polar fields generally by the L-probe. The suppression may include an arc-shaped sleeve attached to the air-filled metallic cable. Optionally, the arc-shaped sleeve is semicircular.

Preferably, the dielectric resonator antenna is a microwave dielectric resonator antenna and the Fabry-Perot resonator antenna is a millimeter wave Fabry-Perot resonator antenna.

Preferably, the antenna further includes a ground plane on which the dielectric block is arranged.

In accordance with a second aspect of the invention, there is provided communication device comprising an antenna of the first aspect. The communication device may include multiple such antennas. The communication device may be operable for 4G and 5G (and subsequent generation) communications. The communication device may be a mobile phone, a computer, a tablet computer, a watch, an IoT device, or any information handle system. The communication device may be a wireless communication device, or may be a communication device operable for both wired and wireless communications.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1A:
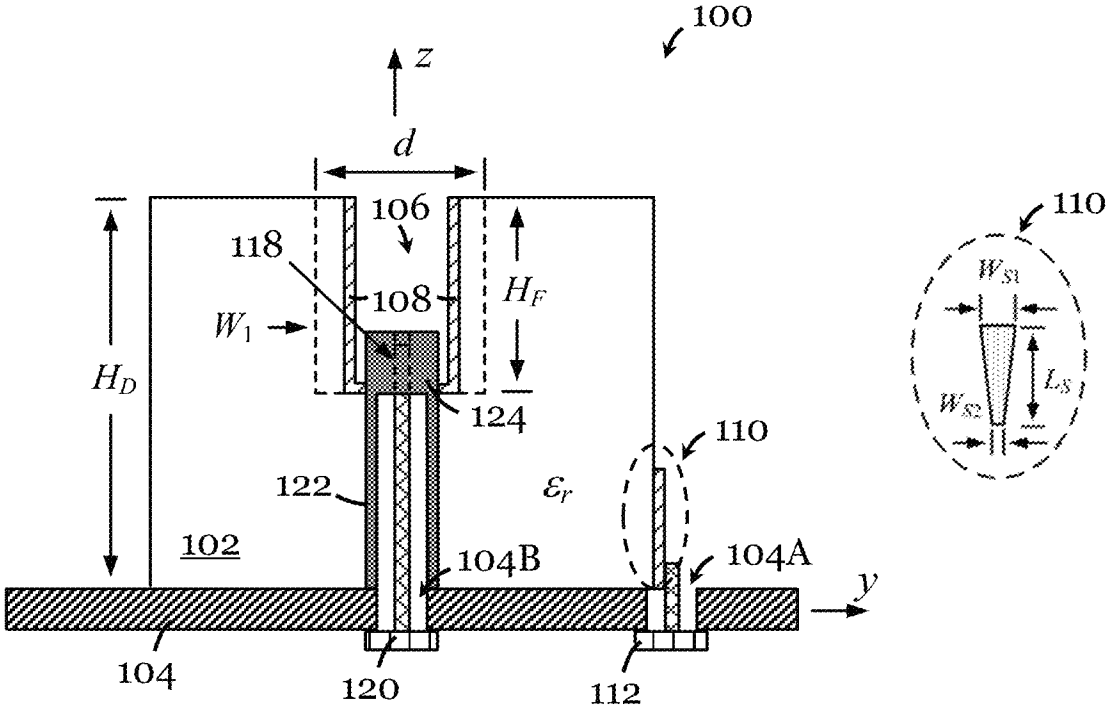
FIG. 1A is a schematic front view of an antenna in one embodiment of the invention.
Figure 1B:
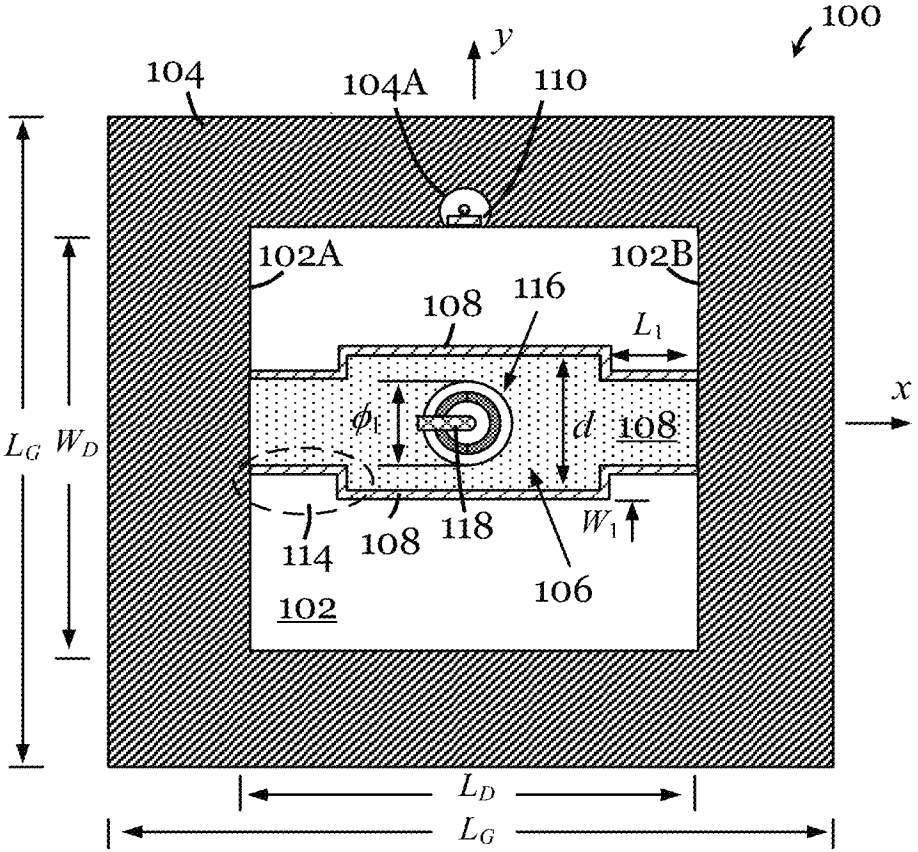
FIG. 1B is a schematic top view of the antenna of FIG. 1A.
Figure 1C:
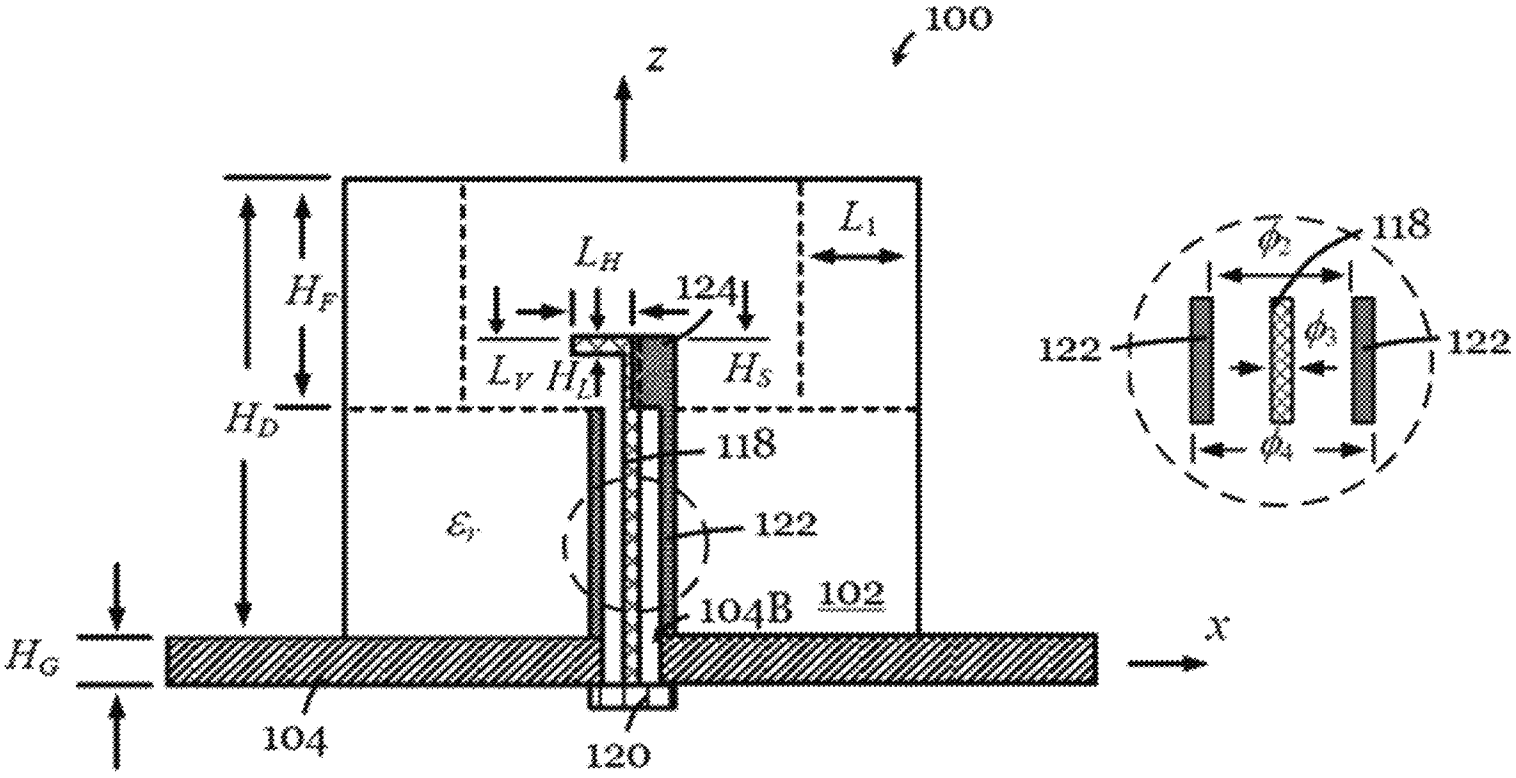
FIG. 1C is a schematic side view of the antenna of FIG. 1A.

FIGS. 1A to 1C shows an antenna 100 in one embodiment of the invention. In this embodiment, the antenna 100 is configured as a dual-frequency antenna incorporating a microwave dielectric resonator antenna and millimeter-wave Fabry-Perot resonator antenna. The antenna 100 generally includes a dielectric block 102 mounted on a ground plane 104. The dielectric block 102 has a groove 106 with conductor 108 arranged inside. The antenna 100 is arranged to be excited to operate as a microwave dielectric resonator antenna and a millimeter-wave Fabry-Perot resonator antenna.

As shown in FIGS. 1A to 1C, the ground plane 104 is generally square-shaped with side lengths $L_G \times L_G$ and thickness $H_G$. The dielectric block 102 is substantially solid and has generally rectangular form. The dielectric block 102 has a length $L_D$, a width $W_D$, a height $H_D$, and a dielectric constant $\varepsilon_r$. The dielectric block 102 includes generally parallel opposite side-surfaces and a base surface that together define the groove 106. The groove 106 extends through the dielectric block 102 from one end 102A of the dielectric block to the other (opposite) end 102B of the dielectric block 102. In this example, the groove 106 generally elongates along a central part of the dielectric block 102. The height (or depth) $H_F$ of the groove 106 is about half of the height $H_D$ of the dielectric block 102.

In this embodiment, the grooved dielectric block 102 provides the microwave dielectric resonator antenna. A conductor strip 110 (e.g., adhesive copper tape) is attached to a base part of an outer surface of the dielectric block 102 (FIG. 1A). The conductor strip 110 is arranged to receive an excitation signal (e.g., from a SMA connector 112 that extends through a through-hole 104A in the ground plane 104) to operate the antenna 100 as the dielectric resonator antenna. The conductor strip 110 may be a generally vertical inverted trapezoidal strip having a vertical height $L_S$, a base width $W_{S2}$, and a top width $W_{S1}$ wider than the base width $W_{S2}$. This trapezoidal configuration may improve impedance match of the dielectric resonator antenna. In another embodiment, the conductor strip 110 may be a generally rectangular strip (when $W_{S1}=W_{S2}$).

Still referring to FIGS. 1A to 1C, the conductor 108 arranged in the groove 106 includes conductor strips arranged on the opposite side-surfaces and the base surface of the dielectric block 102. As best shown in FIG. 1B, the groove 106 includes a first portion at the middle and second and third portions at two ends. At the first portion, the opposite side surfaces are separated by a distance d; at the second and third portions, the opposite side surfaces are separated by a distance smaller than distance d. Theoretically, the distance d between the conductor strips portions 108 at the first portion should be equal to a half wavelength (i.e., a half-wavelength distance). However, in practice, when the finite thickness of the conductor strips portions 108 are considered, the distance d may be slightly larger than a half wavelength. The reduced distance between the conductor strips portions 108 in the second and third portions enables the formation of four ridges 114 sized $L_1 \times W_1$ for suppressing side lobes of the antenna 100 when the antenna 100 is operated as a Fabry-Perot resonator antenna.

Figure 1D:
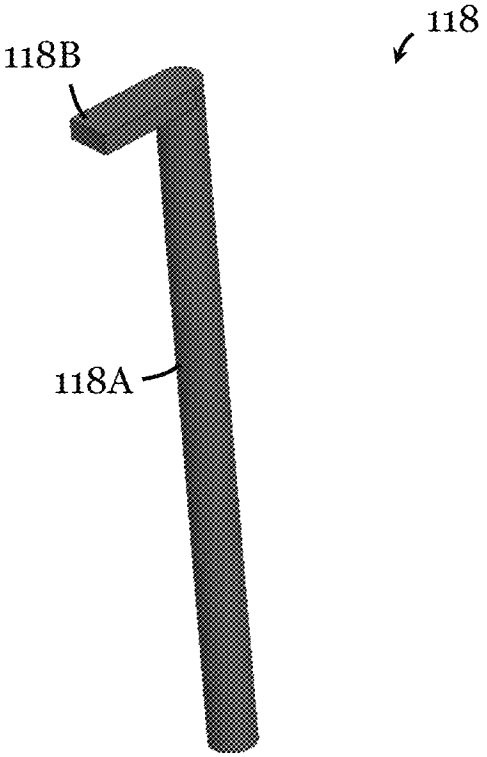
FIG. 1D is a perspective view of an L-probe of the antenna of FIG. 1A.

In this embodiment, the conductor 108 in the groove 106 provides a millimeter-wave Fabry-Perot resonator antenna embedded in the dielectric resonator antenna. The conductor strip 108 on the base surface may provide the ground plane of the Fabry-Perot resonator antenna. As shown in FIGS. 1A to 1C, the dielectric block 102 further includes an generally cylindrical opening 116 arranged at and continuous with a central portion of the groove 106. The opening 116 has a diameter $\Phi_1$ The opening extends below and generally perpendicular to the elongation direction of the groove 106. The ground plane 104 includes a corresponding through-hole 104B aligned with the opening 116. An L-probe 118 extending through the openings 116, 104B is used to receive an excitation signal (e.g., from a SMA connector 120) to operate the antenna 100 as the Fabry-Perot resonator antenna. The L-probe 118 includes a vertical arm portion 118A with length $L_V$ and diameter $\Phi_3$ and a horizontal arm portion 118B with length $L_H$ and height $H_L$ continuous with the vertical arm portion (FIGS. 1C and 1D). The horizontal arm portion extends generally parallel to the elongation direction of the groove 106 (FIG. 1B). As best shown in FIG. 1C, a 50Ω air-filled metallic cable 122 is also arranged in the opening and generally coaxially with the vertical arm portion of the L-probe 118. The cable 122 has an outer diameter $\Phi_4$ and an inner diameter $\Phi_2$. A suppressor in the form of a half-ring sleeve 124 with height $H_S$ extends from an end of the coaxial cable 122 to introduce an opposite current of the L-probe 118 to suppress cross polar fields generally by the L-probe 118.

Figure 2:
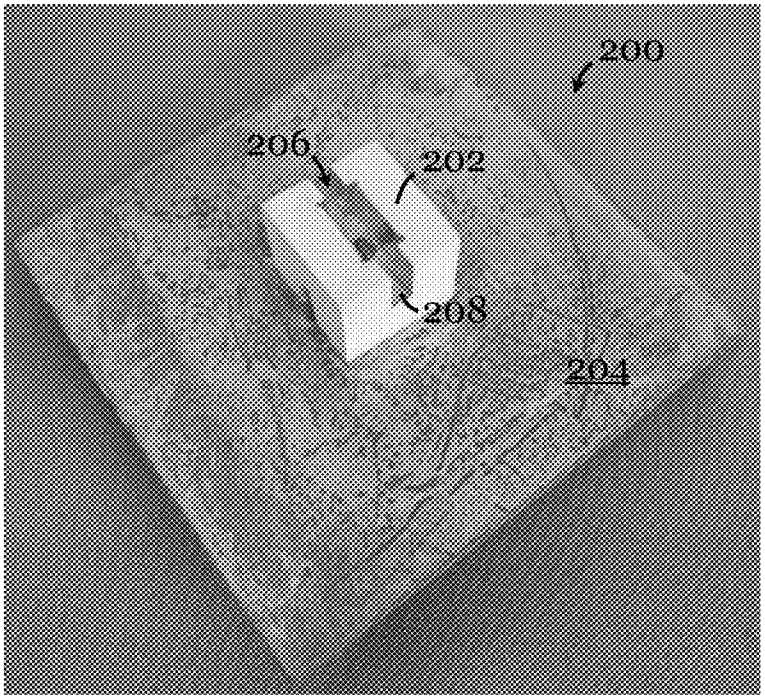
FIG. 2 is a photograph of an antenna fabricated based on the antenna of FIGS. 1A to 1C.

A dual-fed dual-frequency antenna that covers 2.4 GHz and 24 GHz ISM bands was designed using ANSYS HFSS based on the antenna configuration of FIGS. 1A to 1C. FIG. 2 is a picture of the designed dual-fed dual-frequency antenna prototype 200, with the dimensions shown in Table I. As shown in FIG. 2, the antenna 200 includes, generally: a dielectric block 202 with a groove 206 arranged on a ground plane 204, and a conductor 208 arranged in the groove 206.

TABLE I

Dimensions of the Dual-Frequency Antenna

| | Parameter | | | | | | |
|---|---|---|---|---|---|---|---|
| | $L_G$ | $W_D$ | $L_D$ | $W_1$ | $L_1$ | d | $H_G$ |
| Value (mm) | 100 | 24 | 25 | 1.5 | 5 | 7.2 | 4 |
| | Parameter | | | | | | |
| | $H_D$ | $H_F$ | $H_S$ | $H_L$ | $L_H$ | $W_{S1}$ | $W_{S2}$ |
| Value (mm) | 20 | 10 | 2.8 | 0.5 | 2.8 | 2 | 2 |

TABLE I-continued

Dimensions of the Dual-Frequency Antenna

| | Parameter | | | | | | |
|---|---|---|---|---|---|---|---|
| | $L_S$ | $L_V$ | $\Phi_1$ | $\Phi_2$ | $\Phi_3$ | $\Phi_4$ | $\varepsilon_r$ |
| Value (mm) | 10.5 | 2.8 | 4.9 | 1.9 | 1.27 | 4.9 | 10 |

Agilent network analyzers E5071C and E8361A were used to measure the S-parameters of dielectric resonator antenna and Fabry-Perot resonator antenna of the antenna 200 of FIG. 2. Satimo StarLab system and Near-field System Incorporation (NSI) measurement system were used for measuring the radiation pattern, antenna gain, and antenna efficiency of the dielectric resonator antenna and Fabry-Perot resonator antenna of the antenna 200 of FIG. 2.

In this example, in the microwave band, the dielectric resonator antenna resonates in its $TE_{111}^x$ mode.

Figure 3:
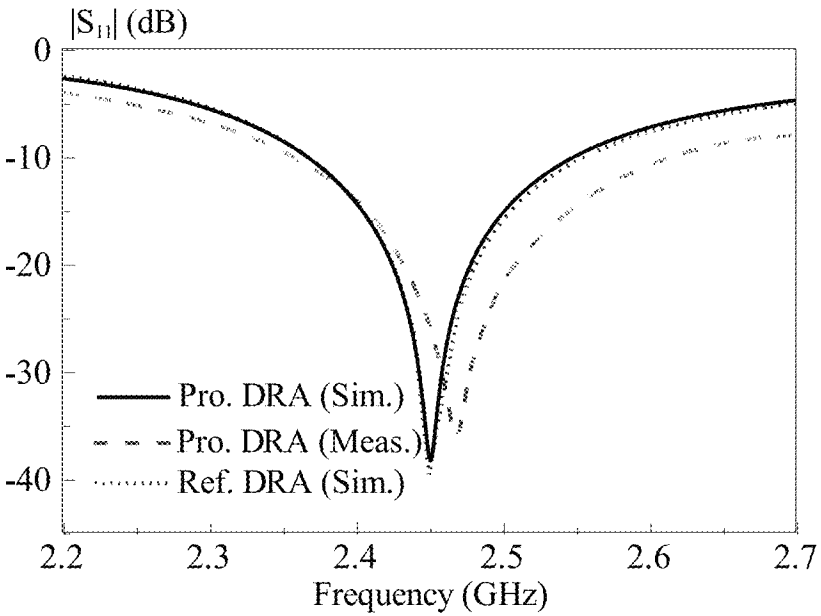
FIG. 3 is a graph showing the measured and simulated reflection coefficients of the dielectric resonator antenna of the antenna 200 of FIG. 2 and simulated reflection coefficient of a dielectric resonator antenna of a reference antenna corresponding to (but different from) the antenna 200 of FIG. 2.

FIG. 3 shows the measured and simulated reflection coefficients of the dielectric resonator antenna of the antenna 200 of FIG. 2. A reasonable agreement between them can be observed. With reference to FIG. 3, the measured and simulated 10-dB impedance bandwidths ($|S_{11}|<-10$ dB) of the dielectric resonator antenna are 10.06% (2.36-2.61 GHz) and 7.32% (2.37-2.55 GHz) respectively. This covers the entire 2.4-GHz ISM band (2.40-2.48 GHz). A 0.018 GHz (0.73%) frequency shift between the measured (2.451 GHz) and simulated (2.469 GHz) resonant frequencies of the dielectric resonator antenna is observed. This frequency shift may be caused by experimental tolerances including machining errors and possible air gaps between the dielectric resonator antenna and ground plane.

To investigate the effect of the Fabry-Perot resonator antenna on the dielectric resonator antenna, a reference solid dielectric resonator antenna having the same dimensions as the dielectric resonator antenna of the antenna 200 of FIG. 2 is considered. The reference dielectric resonator antenna is also excited in the $TE_{111}^x$ mode. It was found that the reference dielectric resonator antenna also resonates at 2.45 GHz when its dielectric constant $\varepsilon_r$ equals 10.6, which is slightly larger than that of the current dielectric resonator antenna ($\varepsilon_r$=10). This means that in practice the integration of the Fabry-Perot resonator antenna does not increase the volume of the antenna. For ease of comparison, the simulated reflection coefficients of the reference dielectric resonator antenna are also illustrated in FIG. 3. It can be seen that the simulated reflection coefficient of the reference dielectric resonator antenna almost overlaps that of the dielectric resonator antenna in the antenna 200 of FIG. 2. This confirms that the integrated Fabry-Perot resonator antenna has negligible effects on the bandwidth of the dielectric resonator antenna.

Figure 4:
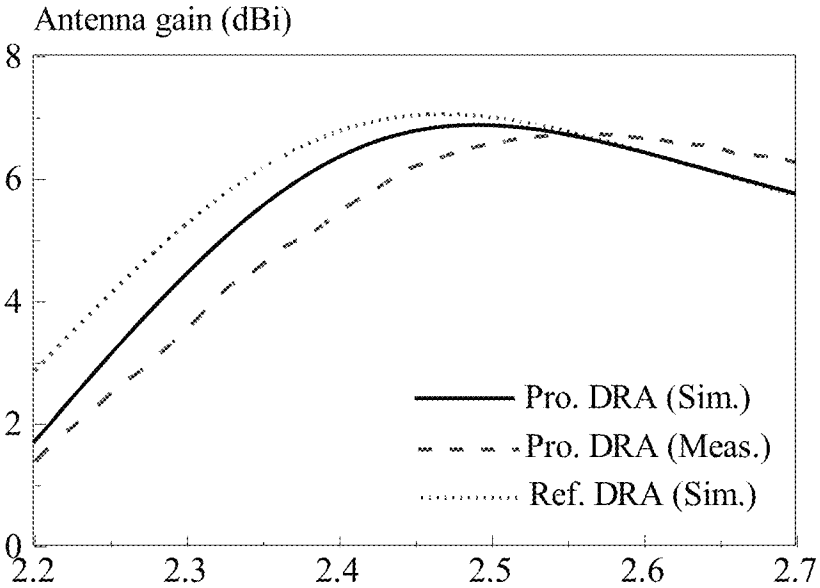
FIG. 4 is a graph showing the measured and simulated boresight antenna gains of the dielectric resonator antenna of the antenna 200 of FIG. 2 and simulated boresight antenna gain of a dielectric resonator antenna of a reference antenna corresponding to (but different from) the antenna 200 of FIG. 2.

FIG. 4 shows the measured and simulated antenna gains of the dielectric resonator antenna of the antenna 200 of FIG. 2 and the reference dielectric resonator antenna. The measured and simulated boresight antenna gains (θ=0) of the dielectric resonator antenna of the antenna 200 of FIG. 2 are 6.71 dBi at 2.57 GHz and 6.86 dBi at 2.49 GHz. As expected, the simulated antenna gains are slightly lower than those of the reference dielectric resonator antenna because the dielectric resonator antenna of the antenna 200 of FIG. 2 has stronger cross-polar fields as a result of the generally rectangular groove. The results above show that the performance of the dielectric resonator antenna is substantially unaffected by the presence of the Fabry-Perot resonator antenna.

Figure 5:
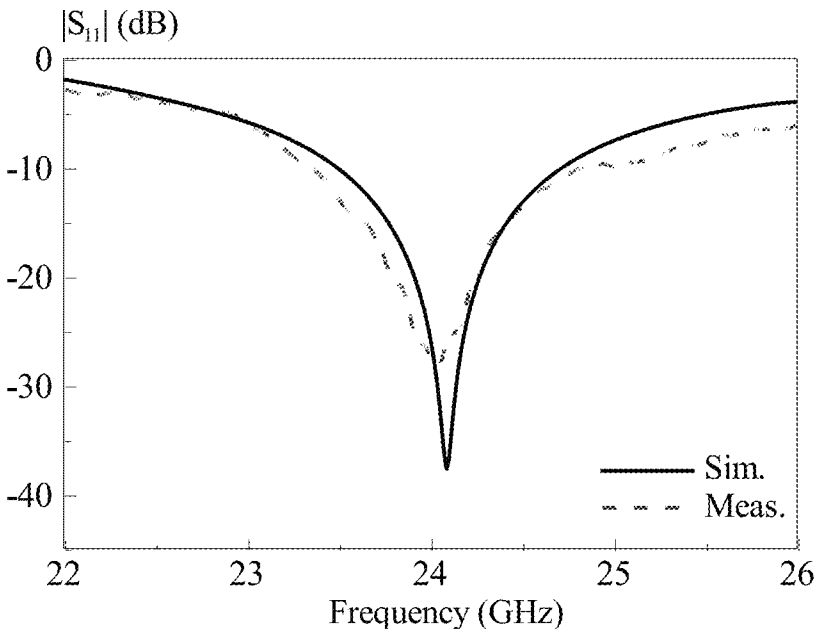
FIG. 5 is a graph showing the measured and simulated reflection coefficient of the Fabry-Perot resonator antenna of the antenna 200 of FIG. 2.

The performance of the Fabry-Perot resonator antenna of the antenna 200 of FIG. 2 was also studied. FIG. 5 shows the measured and simulated reflection coefficients of the Fabry-Perot resonator antenna of the antenna 200 of FIG. 2. As shown in FIG. 5 the measured and simulated resonant frequencies are 24.02 GHz and 24.10 GHz respectively, whereas the measured and simulated impedance bandwidths are 6.3% (23.36-24.88 GHz) and 5.1% (23.49-24.72 GHz), respectively. Both the measured and simulated results cover the entire 24-GHz ISM band (24.0-24.25 GHz).

Figure 6:
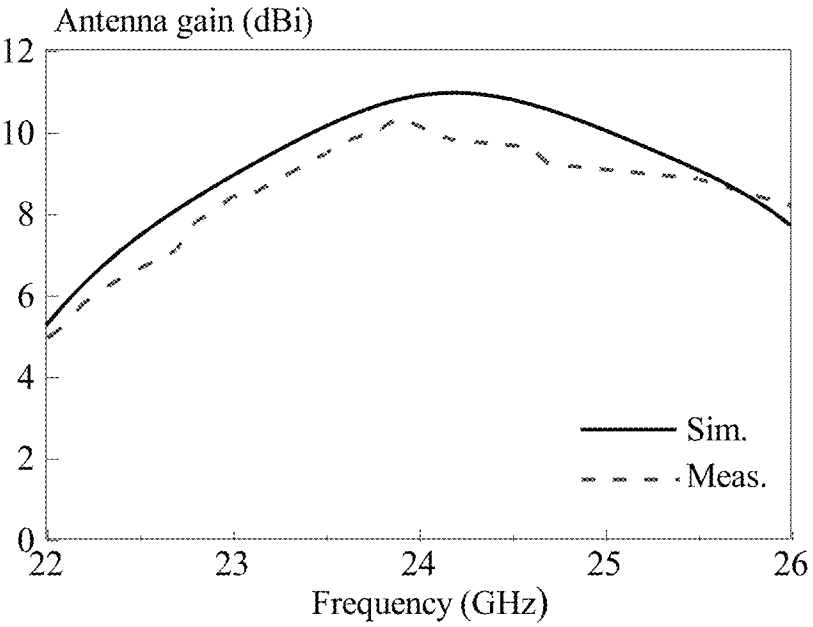
FIG. 6 is a graph showing the measured and simulated boresight antenna gains of the Fabry-Perot resonator antenna of the antenna 200 of FIG. 2.

FIG. 6 shows the measured and simulated boresight antenna gains of the Fabry-Perot resonator antenna of the antenna 200 of FIG. 2. The measured and simulated results are in reasonable agreement. As shown FIG. 6, the measured and simulated boresight antenna gains ($\theta=0°$) are 10.07 dBi at 23.8 GHz and 11.18 dBi at 24.0 GHz, respectively. The measured antenna gain is 1.11 dB lower than the simulated antenna gain. This may be caused by the conductive loss of the conductive strips used in fabricating the Fabry-Perot resonator antenna prototype 200.

In another embodiment, a wideband dual-frequency antenna, based on the antenna configuration of FIGS. 1A and 1C, integrating a wideband dielectric resonator antenna and wideband Fabry-Perot resonator antenna is investigated. In this embodiment, in the microwave part, the wide bandwidth is obtained by merging $TE_{111}^x$ and $TE_{113}^x$ modes of the dielectric resonator antenna. For the millimeter-wave part, the Fabry-Perot resonator antenna mode and two L-probe modes are simultaneously excited and merged to enhance the bandwidth.

Figure 7:
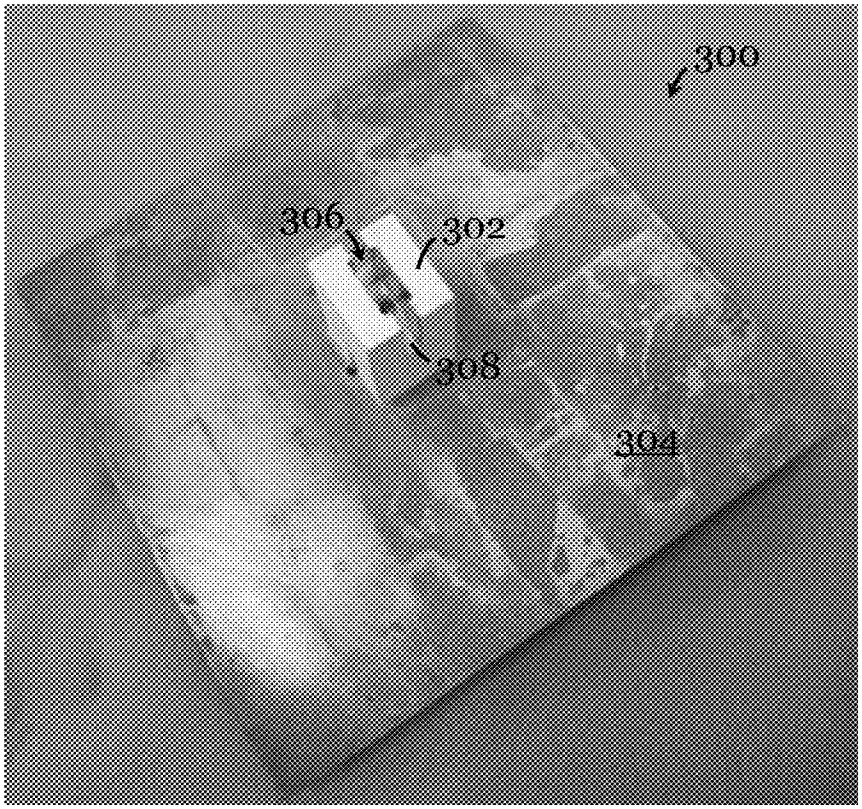
FIG. 7 is a photograph of another antenna fabricated based on the antenna of FIGS. 1A to 1C.

FIG. 7 is a picture of the designed wideband dual-fed dual-frequency antenna prototype 300, with the dimensions shown in Table II. As shown in FIG. 7, the antenna includes, generally: a dielectric block 302 with a groove 306 arranged on a ground plane 304, and a conductor 308 arranged in the groove 306.

TABLE II

Dimensions of the Wideband Dual-Frequency Antenna

| | Parameter | | | | | | |
|---|---|---|---|---|---|---|---|
| | $L_G$ | $W_D$ | $L_D$ | $W_1$ | $L_1$ | d | $H_G$ |
| Value (mm) | 150 | 22 | 25 | 1.5 | 5 | 7.1 | 4 |
| | Parameter | | | | | | |
| | $H_D$ | $H_F$ | $H_S$ | $H_L$ | $L_H$ | $W_{S1}$ | $W_{S2}$ |
| Value (mm) | 34 | 14 | 2.6 | 0.5 | 2.6 | 4 | 2 |
| | Parameter | | | | | | |
| | $L_S$ | $L_V$ | $\Phi_1$ | $\Phi_2$ | $\Phi_3$ | $\Phi_4$ | $\varepsilon_r$ |
| Value (mm) | 11 | 2.7 | 6.1 | 1 | 0.87 | 4.9 | 10 |

To investigate the influence of the wideband Fabry-Perot resonator antenna on the dielectric resonator antenna, a reference wideband solid dielectric resonator antenna excited in its $TE_{111}^x$ and $TE_{113}^x$ modes was also studied. For ease of comparison, the same dielectric resonator antenna dimensions and dielectric constant ($\varepsilon_r=10.6$) are used for the reference dielectric resonator antenna.

Figure 8:
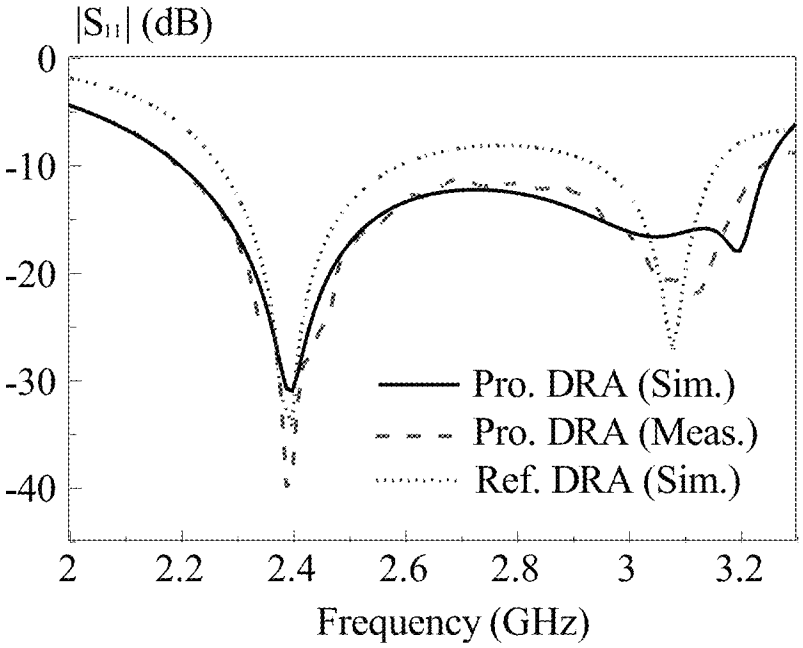
FIG. 8 is a graph showing the measured and simulated reflection coefficients of the dielectric resonator antenna of the antenna of FIG. 7 and simulated reflection coefficient of a dielectric resonator antenna of a reference antenna corresponding to (but different from) the antenna of FIG. 7.

FIG. 8 shows the measured and simulated reflection coefficients of the wideband dielectric resonator antenna of the antenna 300 of FIG. 7, along with the simulated results of the reference wideband dielectric resonator antenna. It can be seen from FIG. 7 that both the resonant $TE_{111}^x$ and $TE_{113}^x$ modes of the dielectric resonator antenna of the antenna 300 of FIG. 7 are excited. The measured and simulated impedance bandwidths of the dielectric resonator antenna of the antenna 300 of FIG. 7 are 38.24% (2.20-3.24 GHz) and 38.53% (2.20-3.25 GHz) respectively, with good agreement between the measured and simulated bandwidths. The two resonant frequencies of the reference dielectric resonator antenna are almost the same as those of the wideband dielectric resonator antenna of the antenna 300 of FIG. 7. This means that the integration of the Fabry-Perot resonator antenna with the dielectric resonator antenna does not increase the volume of the dual-frequency antenna.

Figures 9A, 9B:
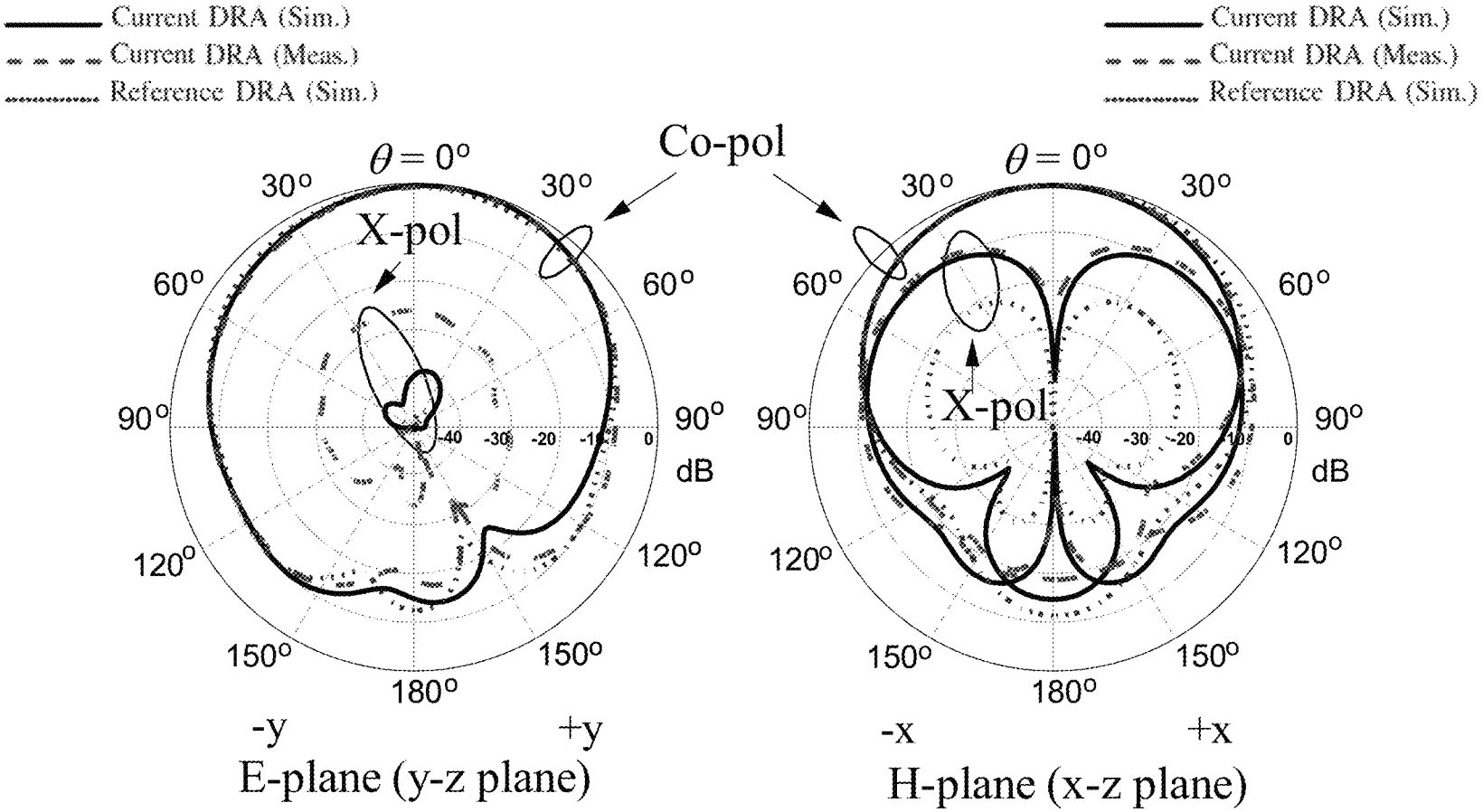
FIG. 9A is a plot showing the measured and simulated E-plane (y-z plane) radiation patterns (at 2.45 GHz) of the dielectric resonator antenna of the antenna of FIG. 7 and simulated E-plane (y-z plane) radiation pattern (at 2.45 GHz) of a dielectric resonator antenna of a reference antenna corresponding to (but different from) the antenna of FIG. 7.
FIG. 9B is a plot showing the measured and simulated H-plane (x-z plane) radiation patterns (at 2.45 GHz) of the dielectric resonator antenna of the antenna of FIG. 7 and simulated H-plane (x-z plane) radiation pattern (at 2.45 GHz) of a dielectric resonator antenna of a reference antenna corresponding to (but different from) the antenna of FIG. 7.

FIGS. 9A and 9B show the measured and simulated radiation patterns of the wideband dielectric resonator antenna of the antenna 300 of FIG. 7 at 2.45 GHz as well as the simulated results of the reference wideband dielectric resonator antenna. As can be observed from FIGS. 9A and 9B, the measured and simulated results of the wideband dielectric resonator antenna of the antenna 300 of FIG. 7 are in reasonable agreement. In the boresight direction ($\theta=0°$), all of the cross-polar fields are weaker than their co-polar counterparts by more than −25 dB. However, due to the presence of the groove, the H-plane cross-polar fields of the wideband dielectric resonator antenna of the antenna 300 of FIG. 7 are higher than those of the reference dielectric resonator antenna.

Figure 10:
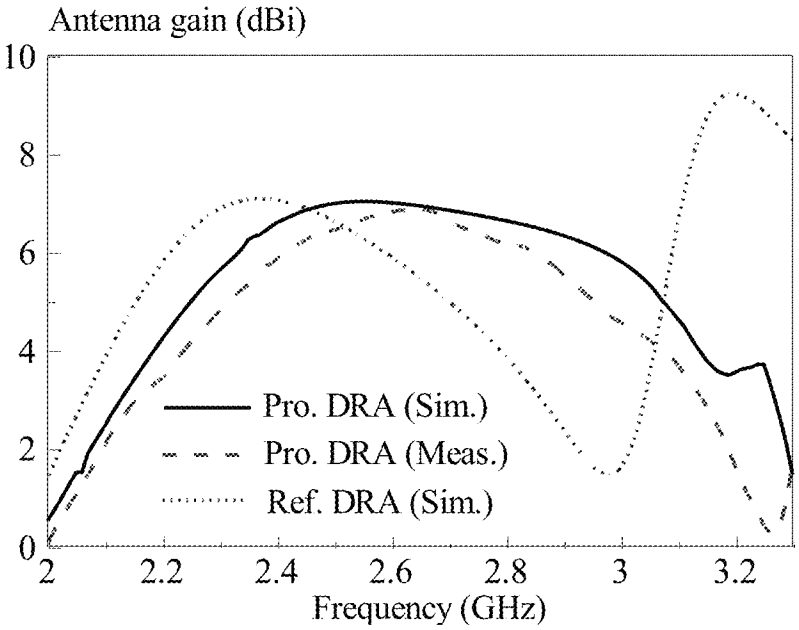
FIG. 10 is a graph showing the measured and simulated antenna gains of the dielectric resonator antenna of the antenna of FIG. 7 and simulated antenna gain of a dielectric resonator antenna of a reference antenna corresponding to (but different from) the antenna of FIG. 7.

FIG. 10 shows the measured and simulated boresight antenna gains of the wideband dielectric resonator antenna of the antenna 300 of FIG. 7 and the simulated gains of the reference wideband dielectric resonator antenna. With reference to FIG. 10, the measured and simulated boresight antenna gains of the wideband dielectric resonator antenna of the antenna 300 of FIG. 7 are higher than 5 dBi from 2.32 to 2.95 GHz and from 2.26 to 3.07 GHz, respectively. As compared with the reference wideband dielectric resonator antenna, the wideband dielectric resonator antenna of the antenna 300 of FIG. 7 has a more stable antenna gain across the frequency range of interest.

Figure 11:
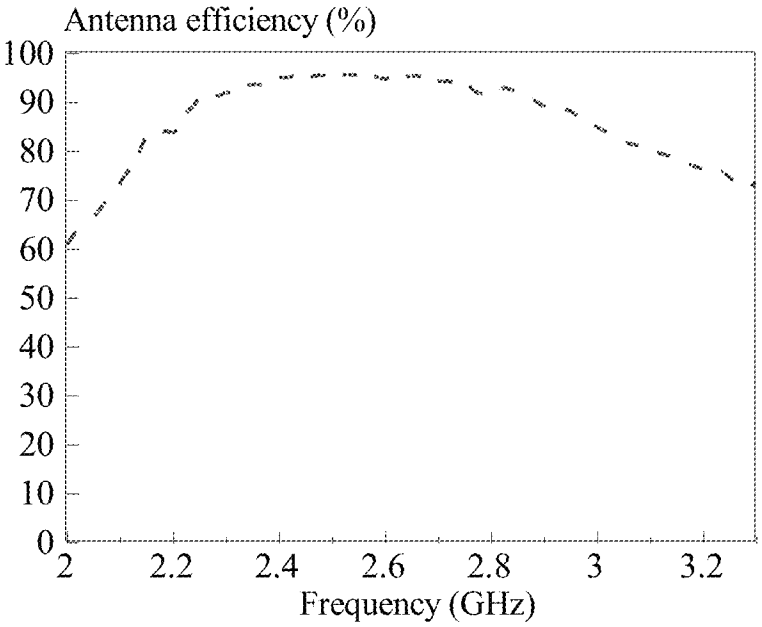
FIG. 11 is a graph showing the measured total antenna efficiency of the dielectric resonator antenna of the antenna of FIG. 7.

FIG. 11 shows the measured antenna efficiency of the wideband dielectric resonator antenna of the antenna 300 of FIG. 7, varying from 74.6% to 95.4% in the 10 dB impedance frequency band, which shows the wideband dielectric resonator antenna of the antenna 300 of FIG. 7 is a high efficient antenna even with a groove along its center.

Figure 12:
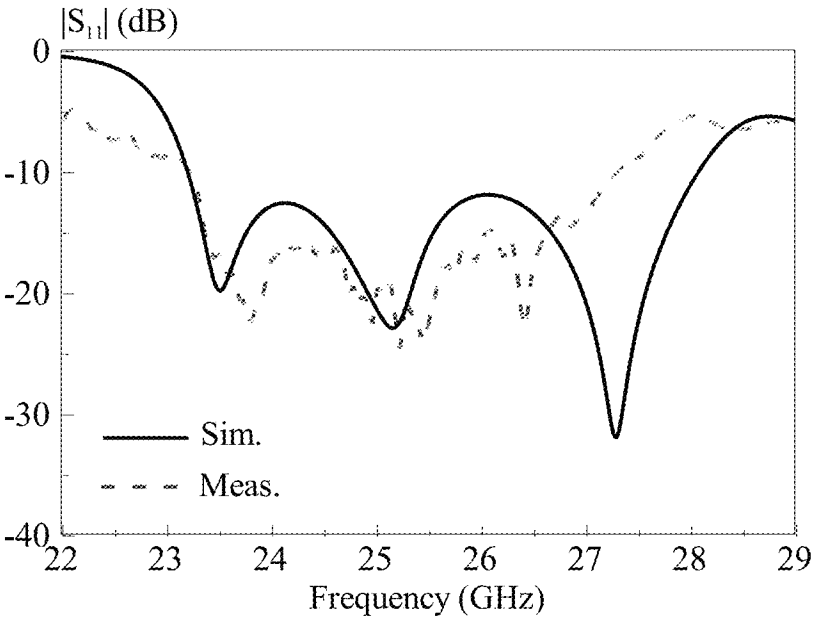
FIG. 12 is a graph showing the measured and simulated reflection coefficients of the Fabry-Perot resonator antenna of the antenna of FIG. 7 and simulated reflection coefficient of a Fabry-Perot resonator antenna of a reference antenna corresponding to (but different from) the antenna of FIG. 7.

The wideband Fabry-Perot resonator antenna of the antenna 300 of FIG. 7 is now studied. FIG. 12 shows the measured and simulated reflection coefficients of the wideband Fabry-Perot resonator antenna of the antenna 300 of FIG. 7. With reference to FIG. 12, the measured and simulated impedance bandwidths of the current Fabry-Perot resonator antenna are 16.18% (23.23-27.32 GHz) and 18.99% (23.21-28.08 GHz), respectively. The measured result has a narrower bandwidth. The discrepancy between the two results may be due to fabrication errors of the L-probe.

Figures 13A, 13B:
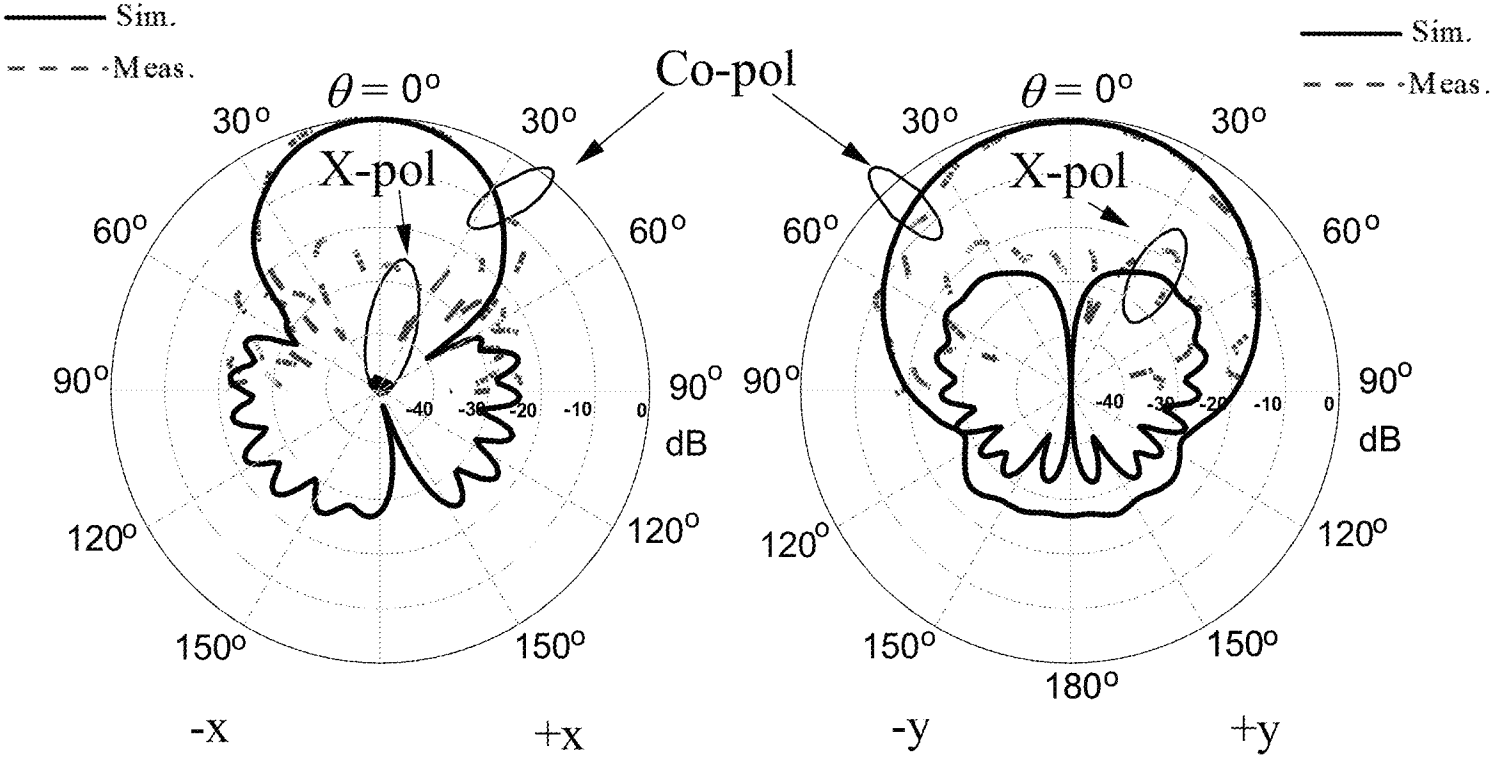
FIG. 13A is a plot showing the measured and simulated E-plane (y-z plane) radiation patterns (at 24 GHz) of the Fabry-Perot resonator antenna of the antenna of FIG. 7 and simulated E-plane (y-z plane) radiation pattern (at 24 GHz) of a Fabry-Perot resonator antenna of a reference antenna corresponding to (but different from) the antenna of FIG. 7.
FIG. 13B is a plot showing the measured and simulated H-plane (x-z plane) radiation patterns (at 24 GHz) of the Fabry-Perot resonator antenna of the antenna of FIG. 7 and simulated H-plane (x-z plane) radiation pattern (at 24 GHz) of a Fabry-Perot resonator antenna of a reference antenna corresponding to (but different from) the antenna of FIG. 7.

FIGS. 13A and 13B show the measured and simulated radiation patterns of the wideband Fabry-Perot resonator antenna of the antenna 300 of FIG. 7 at 24 GHz. It can be seen from FIGS. 13A and 13B that a reasonable agreement between the measured and simulated results is obtained. A distortion and asymmetry in the measured H-plane co-polar pattern is observed. This may be due to imperfections of the test setup. At both frequencies (or frequency bands), the co-polar fields are stronger than their cross-polar counterparts by more than 25 dB.

Figure 14:
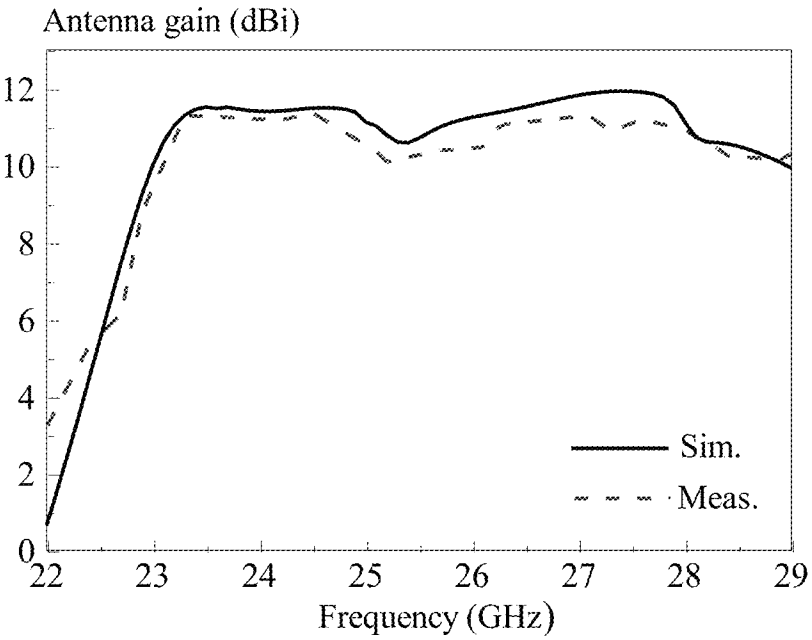
FIG. 14 is a graph showing the measured and simulated antenna gains of the Fabry-Perot resonator antenna of the antenna of FIG. 7 and simulated antenna gain of a Fabry-Perot resonator antenna of a reference antenna corresponding to (but different from) the antenna of FIG. 7.

FIG. 14 shows the measured and simulated boresight antenna gains of the wideband Fabry-Perot resonator antenna of the antenna 300 of FIG. 7. As shown in FIG. 14, the measured and simulated peak gains are 11.30 and 11.93 dBi respectively. Both the measured and simulated results are consistently higher than 10 dBi across the impedance passband.

Figure 15:
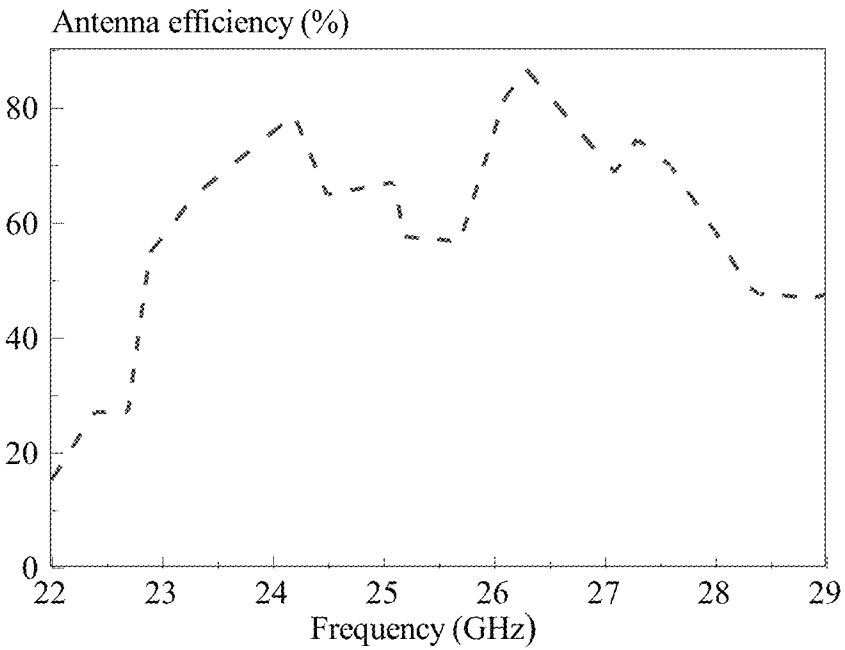
FIG. 15 is a graph showing the measured total antenna efficiency of the Fabry-Perot resonator antenna of the antenna of FIG. 7.

FIG. 15 shows the total antenna efficiency of the wideband Fabry-Perot resonator antenna of the antenna 300 of FIG. 7, which is obtained from the measured realized gain and directivity. FIG. 15 shows that the total antenna efficiency varies from 56.5% to 86.4% over the 10 dB impedance bandwidth. The highest efficiency of 86.4% is lower than that (95.4%) of the wideband dielectric resonator antenna, which is acceptable because the Fabry-Perot resonator antenna operates at a much higher frequency.

The above embodiments of the inventive provide various dual-fed dual-frequency dielectric antennas. In some embodiments, the antenna include a single dielectric block with a groove along its center, and is operable (when excited at the corresponding port) as one or both of the microwave dielectric resonator antenna and millimeter-wave Fabry-Perot resonator antenna. The resonant frequencies of the dielectric resonator antenna and Fabry-Perot resonator antenna can be determined independently for fabrication, making it easy to achieve a large frequency ratio (widely-separated frequency/wave bands). Also, the antenna, by artfully integrating the microwave dielectric resonator antenna with the millimeter-wave Fabry-Perot resonator antenna into one antenna, can be made compact and light. In some embodiments, the antenna is particularly useful for 4G, 5G, 6G, 7G, etc., frequency bands. The antenna of the various embodiments can be used in different communication systems such as RF systems, microwave systems, or wireless systems, and in different communication devices such as computer, phone, IoT devices, smart watches, etc.

It will be appreciated by persons skilled in the art that numerous variations and/or modifications may be made to the invention as shown in the specific embodiments without departing from the spirit or scope of the invention as broadly described. The described embodiments of the invention should therefore be considered in all respects as illustrative, not restrictive. The expressions "vertical", "horizontal", "base", "top", and like expressions in the above disclosure are merely used for illustrative purpose and in a relative sense to describe the antenna in a particular orientation.

For example, the antenna may not be a dual-frequency antenna, but a multi-frequency antenna. The antenna can be excited to selectively operate as one type (frequency band) of antenna at a time or excited to simultaneously operate as two or more types (different frequency bands) of antennas. The antenna may be operable in other frequency/wave bands, not necessarily millimeter and microwave bands. The dielectric resonator antenna need not be a microwave dielectric resonator antenna and the Fabry-Perot resonator antenna need not be a millimeter wave Fabry-Perot resonator antenna. The antenna and its components (the ground plane, the dielectric block, the excitation members, etc.) can have size, shape, geometry, or form different from those illustrated. For example, the ground plane need not be rectangular, and need not be arranged on the side of the dielectric block opposite the groove. The dielectric block need not be rectangular; the groove need not be extending between opposite ends of the dielectric block. The conductor can be conductor strips such as copper strips. Depending on construction and application, the antenna can be excited to different operation modes including those not specifically described. The antenna can support 4G, 5G, or any other future wireless communication standards.

The invention claimed is:

1. An antenna, comprising:

a dielectric block with a groove, and a conductor arranged in the groove;

wherein the antenna is arranged to be excited to operate as a dielectric resonator antenna and a Fabry-Perot resonator antenna; and wherein the antenna further comprises an excitation member for receiving an excitation signal to operate the antenna as the dielectric resonator antenna.

2. The antenna of claim 1, wherein the dielectric block is substantially solid.

3. The antenna of claim 1, wherein the groove extends through the dielectric block from a first end of the dielectric block to a second end of the dielectric block, the first and second ends being opposite ends.

4. The antenna of claim 3, wherein the dielectric block includes opposite side-surfaces and a base surface that together define the groove, and the conductor comprises one or more conductor strips arranged at least partly on the opposite side-surfaces and the base surface.

5. The antenna of claim 4, wherein the opposite side-surfaces are generally parallel.

6. The antenna of claim 4, wherein the opposite side-surfaces are separated by a first distance, and the first distance is at least a half-wavelength distance.

7. The antenna of claim 1, wherein the dielectric block includes opposite side-surfaces, and wherein the groove comprises a first portion at the middle and second and third portions at two ends, wherein at the first portion the opposite side-surfaces are separated by a first distance; at the second portion the opposite side-surfaces are separated by a second distance; at the third portion the opposite side surfaces are separated by a third distance; and the first distance being larger than the second distance and the third distance.

8. The antenna of claim 7, wherein the first distance is at least a half-wavelength distance.

9. The antenna of claim 8, wherein the second distance equals the third distance.

10. The antenna of claim 1, wherein the first excitation member comprises a conductor strip arranged on an outer surface of the dielectric block.

11. The antenna of claim 10, wherein the conductor strip is generally rectangular or generally trapezoidal.

12. The antenna of claim 1, wherein the excitation member is a first excitation member; and wherein the antenna further comprises:

a second excitation member for receiving an excitation signal to operate the antenna as the Fabry-Perot resonator antenna.

13. The antenna of claim 12, wherein the groove generally elongates in a first direction, and the dielectric block further comprises an opening continuous with the groove and generally extends in a second direction perpendicular to the first direction.

14. The antenna of claim 13, wherein the opening is continuous with the groove in a central portion of the groove.

15. The antenna of claim 13, wherein the second excitation member comprises a L-probe arranged at least partly in the opening.

16. The antenna of claim 15, further comprising an air-filled metallic cable arranged in the opening and generally coaxially with a portion of the L-probe in the opening.

17. The antenna of claim 16, further comprising a suppressor for suppressing cross polar fields generally by the L-probe.

18. The antenna of claim 17, wherein the suppressor comprises an arc-shaped sleeve attached to the air-filled metallic cable.

19. The antenna of claim 18, wherein the arc-shaped sleeve is semicircular.

20. The antenna of claim 19, wherein the dielectric resonator antenna is a microwave dielectric resonator antenna and the Fabry-Perot resonator antenna is a millimeter wave Fabry-Perot resonator antenna.

21. The antenna of claim 1, further comprising a ground plane, and the dielectric block is arranged on the ground plane.

22. An antenna, comprising:

a dielectric block including opposite side-surfaces and a base surface that together define a groove, the groove extending through the dielectric block from a first end of the dielectric block to a second end of the dielectric block, the first end being opposite the second end; and a conductor arranged in the groove, the conductor comprising one or more conductor strips arranged at least partly on the opposite side-surface and the base surface; and wherein the antenna is arranged to be excited to operate as a dielectric resonator antenna and a Fabry-Perot resonator antenna.

23. The antenna of claim 22, wherein the groove comprises a first portion at the middle and second and third portions at two ends, wherein at the first portion the opposite side-surfaces are separated by a first distance; at the second portion the opposite side-surfaces are separated by a second distance; at the third portion the opposite side-surfaces are separated by a third distance; and the first distance being larger than the second distance and the third distance.

24. The antenna of claim 22, further comprising:

a first excitation member for receiving an excitation signal to operate the antenna as the dielectric resonator antenna; and a second excitation member for receiving an excitation signal to operate the antenna as the Fabry-Perot resonator antenna.

25. An antenna comprising:

a dielectric block with opposite side-surfaces and a groove; and a conductor arranged in the groove; wherein the groove comprises a first portion at the middle and second and third portions at two ends, wherein at the first portion the opposite side-surfaces are separated by a first distance; at the second portion the opposite side-surfaces are separated by a second distance; at the third portion the opposite side-surfaces are separated by a third distance; and the first distance being larger than the second distance and the third distance; and wherein the antenna is arranged to be excited to operate as a dielectric resonator antenna and a Fabry-Perot resonator antenna.

* * * * *